US005457960A

United States Patent [19]

Morishita

[11] Patent Number: 5,457,960

[45] Date of Patent: Oct. 17, 1995

[54] HYDRAULIC CONTROL SYSTEM

[75] Inventor: Yutaro Morishita, Sakai, Japan

[73] Assignee: Kubota Corporation, Osaka, Japan

[21] Appl. No.: 250,457

[22] Filed: May 27, 1994

[30] Foreign Application Priority Data

May 28, 1993 [JP] Japan ..... 5-126689
May 28, 1993 [JP] Japan ..... 5-126690

[51] Int. Cl.[6] ..... F15B 13/16; F15B 13/044

[52] U.S. Cl. ..... 91/361; 91/459

[58] Field of Search ..... 60/420, 459; 91/511, 91/459, 361

[56] References Cited

U.S. PATENT DOCUMENTS

| | | | |
|---|---|---|---|
| 3,821,625 | 6/1979 | Scholl . | |
| 4,205,592 | 6/1980 | Haussler . | |
| 4,625,622 | 12/1986 | Gunda et al. | 91/459 X |
| 4,766,921 | 8/1988 | Williams | 91/459 X |
| 4,884,402 | 12/1989 | Strenzke et al. | 91/459 X |
| 5,012,722 | 5/1991 | McCormick | 91/459 X |
| 5,046,312 | 9/1991 | Tsuda et al. . | |
| 5,218,895 | 6/1993 | Lukich et al. | 60/459 X |
| 5,230,272 | 7/1993 | Schmitz | 91/361 |

FOREIGN PATENT DOCUMENTS

| | | |
|---|---|---|
| 0587902 | 3/1979 | European Pat. Off. . |
| 2-256901 | 10/1990 | Japan . |

*Primary Examiner*—Edward K. Look
*Assistant Examiner*—Hoang Nguyen
*Attorney, Agent, or Firm*—Fisher & Associates

[57] ABSTRACT

A hydraulic control system for controlling a flow control valve to drive a hydraulic actuator in response to operation of a control device. This system includes a position detecting sensor for detecting a displacement of the control device, an operation detecting sensor for detecting an operating state of the flow control valve, and a hydraulic control unit for receiving detection signals from the position detecting sensor and the operation detecting sensor. The hydraulic control unit includes a control signal generator for generating a control signal to control the flow control valve to an opening degree corresponding to the displacement of the control device, a corrector for establishing, as a bias, a value of the control signal occurring when the operation detecting sensor detects start of an operation of the flow control valve, and for applying the bias to the control signal generated by the control signal generator, and a control signal output for outputting a corrected control signal produced by the corrector to the flow control valve.

17 Claims, 6 Drawing Sheets

HYDRAULIC CONTROL SYSTEM

BACKGROUND OF THE INVENTION

1. Field of the Invention

The present invention relates to a hydraulic control system for controlling a flow control valve to drive a hydraulic actuator in response to operation of a control device (such as a control lever or control pedal). More particularly, the invention relates to a control system for controlling a hydraulic actuator or actuators mounted on a working vehicle such as a backhoe or loader.

2. Description of the Related Art

Hydraulic actuator control systems for working vehicles as noted above are disclosed in U.S. Pat. No. 5,046,312 and Japanese Patent Publication Kokai No. 2-256901, for example.

These systems include a swiveling hydraulic motor acting as a hydraulic actuator, an electromagnetic proportional flow control valve for receiving pressure oil from a pump to control the hydraulic motor, a control lever, and a position sensor for detecting control positions of the control lever. According to such a construction, when the control lever lies in a neutral stop position, the position sensor detects this state. Based on a detection value provided by this sensor, the flow control valve is operated to a neutral position to stop the hydraulic motor. As the control lever is operated from the neutral stop position to an operative position, a control electric current is outputted to the flow control valve to cause the flow control valve to supply pressure oil at the higher flow rate the greater the amount of operation of the control lever. Consequently, the flow control valve is switched from the neutral position to a pressure oil supplying position.

Thus, the hydraulic motor is operable at the higher rotating rate, the greater amount the control lever is operated from the neutral stop position. By selecting a control position of the control lever, the hydraulic motor may be driven at a desired speed.

An agreement between control position of the control lever and operating speed of the hydraulic motor may be maintained, provided that the control position of the control lever and the operating speed of the hydraulic motor remain constant under any load conditions and characteristics of all elements forming hydraulic circuitry.

However, where, for example, each flow control valve manufactured has a different characteristic to other flow control valves, the flow control valve in each system, e.g. each backhoe, has a different amount of operation corresponding to a certain control position of the control lever. This could result in a different flow rate of pressure oil from the flow control valve. That is, even when the control lever is operated the same amount, a hydraulic actuator such as a hydraulic motor in each system may be operated at a different rate.

Further, even if an amount of operation of the flow control valve corresponding to a control position of the control lever is the same for different working vehicles, variations in the flow rate of pressure oil from the pump to the flow control valve would result in variations in the flow rate of pressure oil from the flow control valve. Consequently, when the control lever is operated the same amount in each operating condition, the hydraulic actuator may be operated at a different rate.

SUMMARY OF THE INVENTION

The object of the present invention is to provide a hydraulic control system which assures a fixed relationship between control position of a manual control device and operating state of a flow control valve, thus, for example, operating speed of a hydraulic actuator, while minimizing influences of a difference in characteristics of each flow control valve and variations in load conditions and characteristics of a hydraulic system.

The above object is fulfilled, according to the present invention, by a hydraulic control system comprising position detecting means for detecting a displacement of a control device, operation detecting means for detecting an operating state of the hydraulic control system, and hydraulic control means for receiving detection signals from the position detecting means and the operation detecting means, the hydraulic control means including:

- control signal generating means for generating a control signal to control a flow control valve to an opening degree corresponding to the displacement of the control device;
- correcting means for establishing, as a bias, a value of the control signal occurring when the operation detecting means detects start of an operation of the flow control valve (thus, start of movement of a hydraulic actuator), and for applying the bias to the control signal generated by the control signal generating means; and
- control signal output means for outputting a corrected control signal produced by the correcting means to the flow control valve.

In the above construction, the control signal value occurring when the flow control valve starts operating is established as a bias. The control signal outputted to the flow control valve is a sum of the bias and a control signal value corresponding to a displacement of the control device.

Even if the characteristics of the control valve and other components vary from system to system, this hydraulic control system enables a constant relationship between displacement of the control device and operating state of the control valve by adding the above bias to the control signal.

Where a constant flow rate of pressure oil supplied to the flow control valve is not assured, the operating state of the actuator is variable each time even if a desired opening amount of the flow control valve is obtained by operating the control device. The principle of the present invention may be employed to eliminate this inconvenience also. That is, the hydraulic control system may comprise flow rate detecting means for detecting an amount of fluid supplied to the flow control valve, and the hydraulic control means may include:

- control signal generating means for generating a control signal to control the flow control valve to an opening degree corresponding to the displacement of the control device;
- correcting means for correcting the control signal generated by the control signal generating means, based on the amount of fluid supplied to the flow control valve and detected by the flow rate detecting means; and
- control signal output means for outputting a corrected control signal produced by the correcting means to the flow control valve.

According to this construction, when, for example, pressure oil is supplied at an increased flow rate from the pump to the flow control valve, the control signal value outputted to the flow control valve is corrected to reduce the flow rate of pressure oil from the control valve. Conversely, when pressure oil is supplied at a reduced flow rate from the pump to the flow control valve, the control signal value outputted to the flow control valve is corrected to increase the flow rate of pressure oil from the control valve.

Thus, with the single hydraulic control system, it is possible to maintain a constant relationship between control position of the manual control device and flow rate of pressure oil from the control valve (thus, operating speed of the actuator) regardless of variations in the flow rate of pressure oil supplied from the pump to the flow control valve occurring to cope with varied working conditions.

Further, when the actuator is subjected to a great load, a displacement of the control device for a low speed operation could result in the actuator stopping suddenly. The principle of the present invention may be employed to eliminate this inconvenience also. That is, the hydraulic control means may include:

control signal generating means for generating a control signal to control the flow control valve to an opening degree corresponding to the displacement of the control device;

correcting means operable, when an operating speed of the hydraulic actuator detected by the operation detecting means reaches a predetermined standard low speed value, to replace forcibly the control signal generated by the control signal generating means with a low speed operation control signal corresponding to the standard low speed value; and control signal output means for outputting the low speed operation control signal to the flow control valve.

According to this construction, when the operating speed of the actuator falls to a predetermined low speed, the control signal outputted to the flow control valve is corrected to provide a predetermined flow rate of pressure oil from the control valve.

This allows a minimum operating speed to be secured regardless of a load applied to the actuator. As a result, the actuator may be operated to and stopped at a desired position.

Other features and advantages of the present invention will be apparent from the following description of preferred embodiments of the invention taken in conjunction with the accompanying drawings.

DETAILED DESCRIPTION OF THE PREFERRED EMBODIMENTS

Embodiments of the present invention will be described hereinafter with reference to the drawings.

Figure 1:
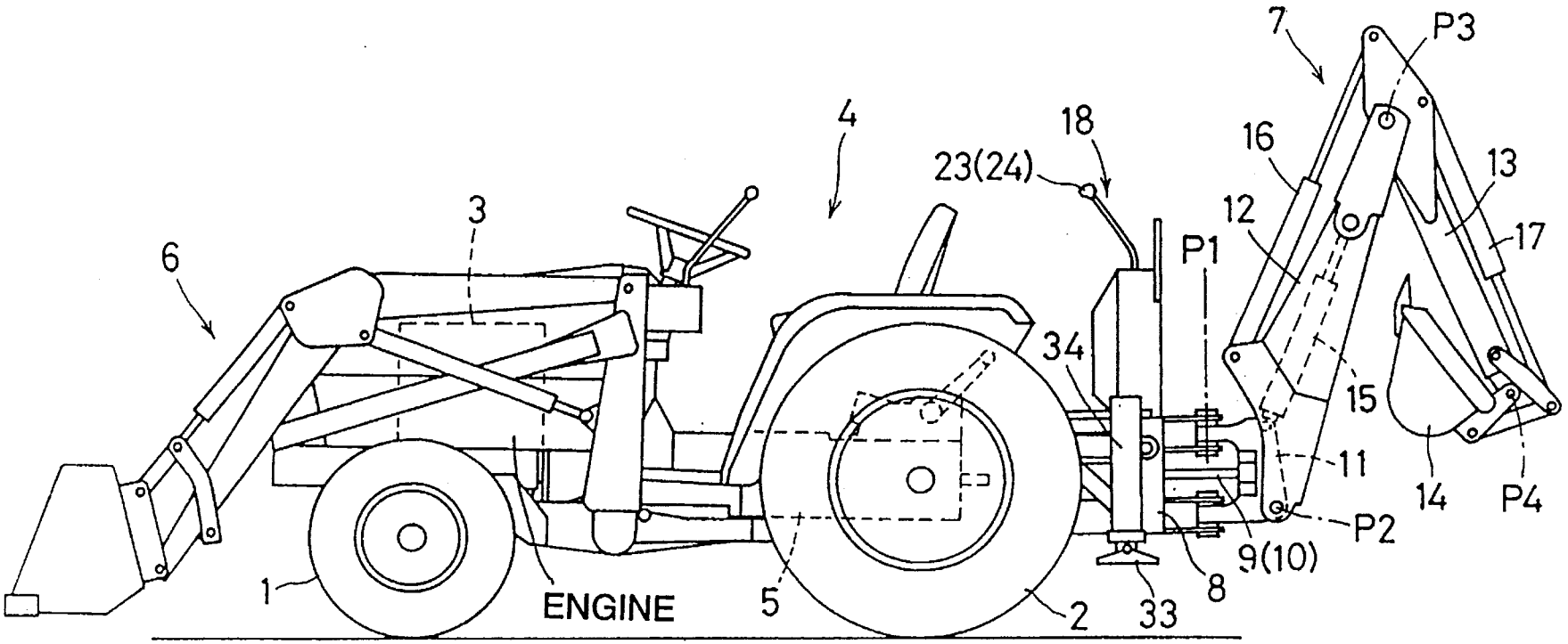
FIG. 1 is a side elevation of a tractor with a dozer implement and a backhoe implement attached thereto, and having a hydraulic control system according to the present invention.

As shown in FIG. 1, a tractor which is one example of working vehicles includes a pair of front wheels 1 and a pair of rear wheels 2 supporting a tractor body. The tractor body includes an engine 3 disposed in a front position, a driver's section 4 disposed in a middle position, and a transmission case 5 disposed in a rear position thereof. A dozer implement 6 is attached to the front of the tractor, and a backhoe implement 7 attached to the rear of the tractor. The backhoe implement 7 will be described next. As shown in FIG. 1, the backhoe implement 7 includes a support 8 connected to the rear of the transmission case 8. The support 8 supports a swing bracket 11 swingable left and right about a vertical axis P1 by a pair of left and fight hydraulic cylinder 9 and 10 (corresponding to hydraulic actuators). The swing bracket 11 supports a boom 12 pivotable about a horizontal axis P2 by a hydraulic cylinder 15. The boom 12 supports an arm 13 pivotable about a horizontal axis P3 at an extreme end of the boom 12 by a hydraulic cylinder 16. The arm 13 supports a bucket 14 pivotable about a horizontal axis P4 at an extreme end of the arm 13 by a hydraulic cylinder 17. The backhoe implement 7 further includes a pair of left and right outriggers 33 vertically movable by hydraulic cylinders 34, and a control section 18 fixed to the support 8.

A structure for controlling the backhoe implement 7 will be described next.

Figure 2:
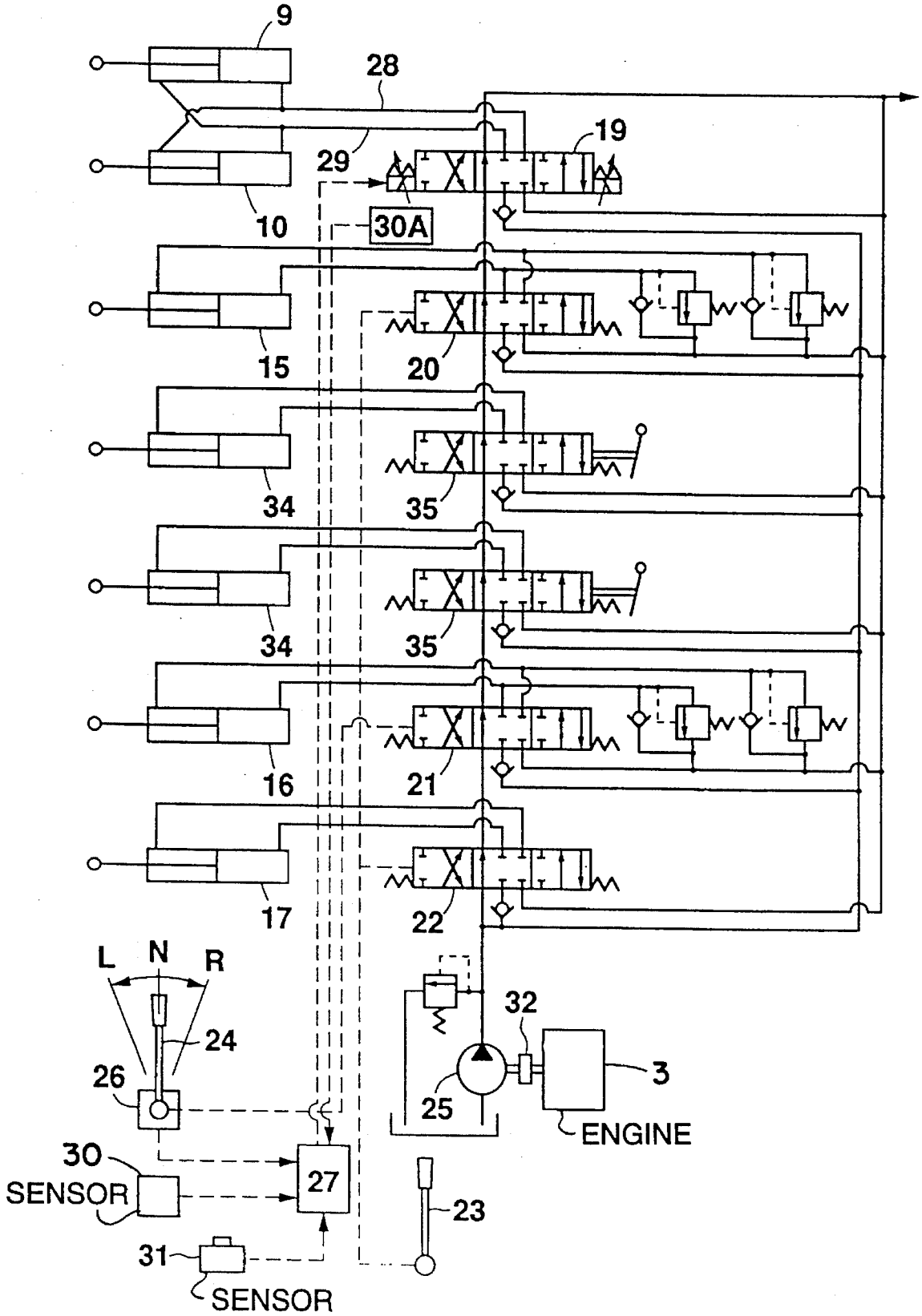
FIG. 2 is a diagram of hydraulic circuitry for controlling the backhoe implement.

As shown in FIG. 2, this control structure includes a flow control valve 19 connected to the pair of hydraulic cylinder 9 and 10 to control the swing bracket 11, a control valve 20 connected to the hydraulic cylinder 15 to control the boom 12, a pair of control valves 35 connected to the hydraulic cylinders 34 to control the outriggers 33, a control valve 21 connected to the hydraulic cylinder 16 to control the arm 13, and a control valve 22 connected to the hydraulic cylinder 17 to control the bucket 14. The flow control valve 19 is a center bypass, neutral restoring type valve. The control valves 20, 21, 22 and 35 are center bypass type, mechanically operated valves. The flow control valve 19 and control valves 20, 21, 22 and 35 are connected in parallel to one another to a pump 25.

As shown in FIGS. 1 and 2, the control section 18 of the backhoe implement 7 includes a right control lever 23 and a left control lever 24 operable fore and aft and left and right. The right control lever 23 is mechanically interlocked to the control valve 20 for controlling the boom 12, and to the control valve 20 for controlling the bucket 14. When the fight control lever 23 is operated fore and aft, the-control valve 20 is switched to swing the boom 12. When the right control lever 23 is operated left and fight, the control valve 22 is switched to swing the bucket 14.

The left control lever 24 is mechanically interlocked to the control valve 21 for controlling the arm 13. When the left control lever 24 is operated fore and aft, the control valve 21 is switched to swing the arm 13.

A position sensor 26 is provided to detect left and right control positions of the left control lever 24. The position sensor 26 outputs detection values to be inputted to a control unit 27 described in detail later. When the left control lever 24 is operated left and right, the control unit 27 outputs control signals based on the detection values provided by the position sensor 26, for controlling the flow control valve 19, which is an electromagnetic proportional control valve, to swing the swing bracket 11 left and right. In this embodiment, the electromagnetic proportional control valve 19 is a digital control valve with an opening amount adjustable by duty ratios of a pulse signal. Various control currents are supplied thereto based on the duty ratios. However, to facilitate understanding, this pulse signal is regarded as the control current in the following description. That is, a control current having a large value means a pulse signal having a high duty ratio.

Operating states of the electromagnetic proportional control valve 19 are fed back to the control unit 27 in the form of electric signals. This feedback system uses a known technique, and will not particularly be described herein. The feedback system is simply represented by a dotted line extending between the electromagnetic proportional control valve 19 and control unit 27, and a sensor 30A acting as an operating state detector.

Operation of the swing bracket 11 of the backhoe implement 7 will be described next.

Figure 3A:
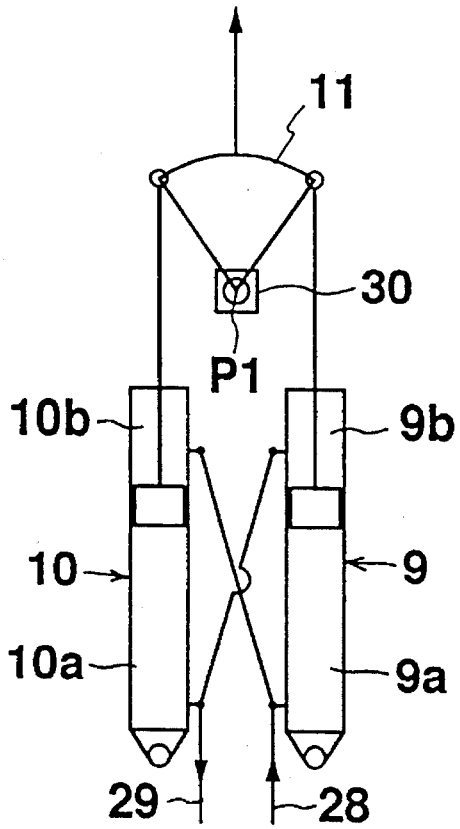
FIGS. 3A through 3C are schematic views showing different positions of a swing bracket of the backhoe implement.

As shown in FIGS. 3A and 1, the swing bracket 11 is supported to be swingable left and right about the vertical axis P1 of the support 8 of the backhoe implement 7. The pair of left and right hydraulic cylinders 9 and 10 of the double acting type are opposed to each other across the vertical axis P1 and connected to the swing bracket 11.

As shown in FIGS. 3A and 2, a pair of oil lines 28 and 29 extend from the electromagnetic proportional control valve 19. One of the oil lines 28 is connected in parallel to an oil chamber 9*a* for extending one of the hydraulic cylinders 9 and to an oil chamber 10*b* for contracting the other hydraulic cylinder 10. The other oil line 29 is connected in parallel to an oil chamber 9*b* for contracting one of the hydraulic cylinders 9 and to an oil chamber 10*a* for extending the other hydraulic cylinder 10.

FIG. 3A shows the swing bracket 11 lying in a transversely middle position. When, in this position, pressure oil is supplied from the electromagnetic proportional control valve 19 to the oil line 28, for example, one of the hydraulic cylinders 9 begins to extend, and the other hydraulic cylinder 10 begins to contract, whereby the swing bracket 11 begins to swing leftward.

Figure 3B:
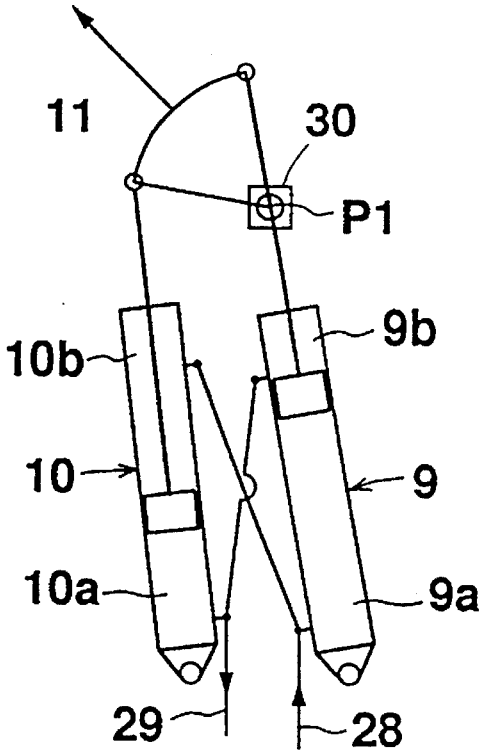
Figure 3C:
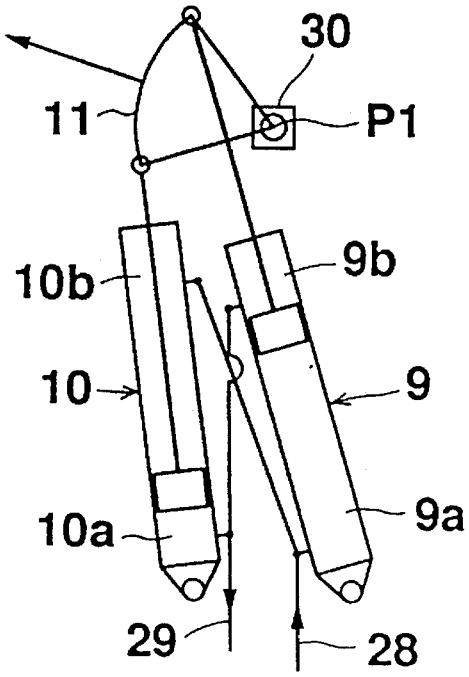

When one of the hydraulic cylinders 9 reaches the vertical axis P1 as shown in FIG. 3B, the hydraulic cylinder 9 is extended near a stroke end. Then, the pressure oil drained from the extension-side oil chamber 10*a* of the other hydraulic cylinder 10 as a result of contraction thereof is supplied to the contraction-side oil chamber 9*b* of the hydraulic cylinder 9. Consequently, the hydraulic cylinder 9 is also contracted, whereby the swing bracket 11 reaches a leftward limit of its swinging range as shown in FIG. 3C.

A similar situation occurs when swinging the swing bracket 11 rightward.

Operation of the left control lever 24 to control the hydraulic cylinders 9 and 10 of the swing bracket 11 will be described next.

Figure 4:
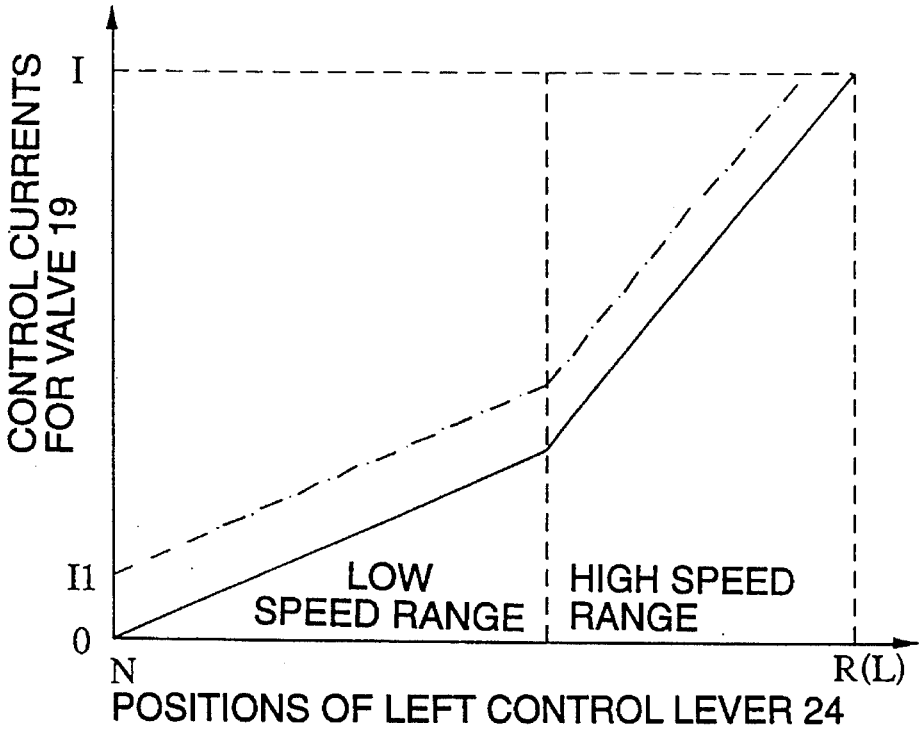
FIG. 4 is a view showing a relationship between control position of a left control lever and control current applied to an electromagnetic proportional control valve.

Initially, at the manufacturing stage, a relationship as shown in solid line A1 in FIG. 4 is set between the detection values of the position sensor 26 for detecting left and right control positions of the left control lever 24 and the control currents provided for the electromagnetic proportional control valve 19 for controlling the hydraulic cylinders 9 and 10.

With this setting, when the left control lever 24 is operated to a neutral stop position N, the control current for the electromagnetic proportional control valve 19 becomes zero. Then, the proportional control valve 19 moves to a neutral position by its own neutral restoring function. The hydraulic cylinders 9 and 10 stop as a result.

Next, as the left control lever 24 is operated from the neutral stop position N toward a right control position R or a left control position L, the control current outputted to the electromagnetic proportional control valve 19 increases progressively to open the control valve 19 to a greater degree. Thus, the greater the amount of operation of the left control lever 24, the higher is the flow rate of pressure oil from the electromagnetic proportional control valve 19. The first half of the solid line A1 extending from the neutral stop position N has a gentle gradient, while the second half thereof extending to the right or left control position R or L has a sharp gradient. This allows subtle speed changes to be effected through the left control lever 24 in the first half of operation from the neutral stop position N during which the hydraulic cylinders 9 and 10 are operable at relatively low speeds.

However, when the backhoe implement 7 is mass produced, there may occur variations in the electromagnetic proportional control valve 19.

With the setting made as shown in the solid line A1, the electromagnetic proportional control valve 19 may receive a control current corresponding to a slow operation of the left control lever 24 from the neutral stop position N to the right or left control position R or L. However, because of the variations noted above, some electromagnetic proportional control valves 19 may start operating only when the left control lever 24 has been operated to a certain extent toward the right or left control position R or L.

In each backhoe implement 7, therefore, the electromagnetic proportional control valve 19 is opened to a different degree (i.e. a different amount of pressure oil flows from the electromagnetic proportional control valve 19) although the left control lever 24 is operated to the same position toward the right or left control position R or L. As a result, the backhoe implement 7 is swung at a different speed.

That is, after the setting is made as shown in the solid line A1 (see FIG. 4), the left control lever 24 is first operated slowly from the neutral stop position N toward the right or left control position R or L. Then, the electromagnetic proportional control valve 19 begins to operate from the neutral position to an oil supplying position for the first time. In a hydraulic control system according to the present invention, a feedback signal outputted from the electromagnetic proportional control valve 19 at that time is inputted to the control unit 27 as a start control current I1 for causing the electromagnetic proportional control valve 19 to start operating from the neutral position toward the oil supplying position. The control unit 27 uses this feedback signal for subsequent control of the electromagnetic proportional control valve 19.

Figure 5:
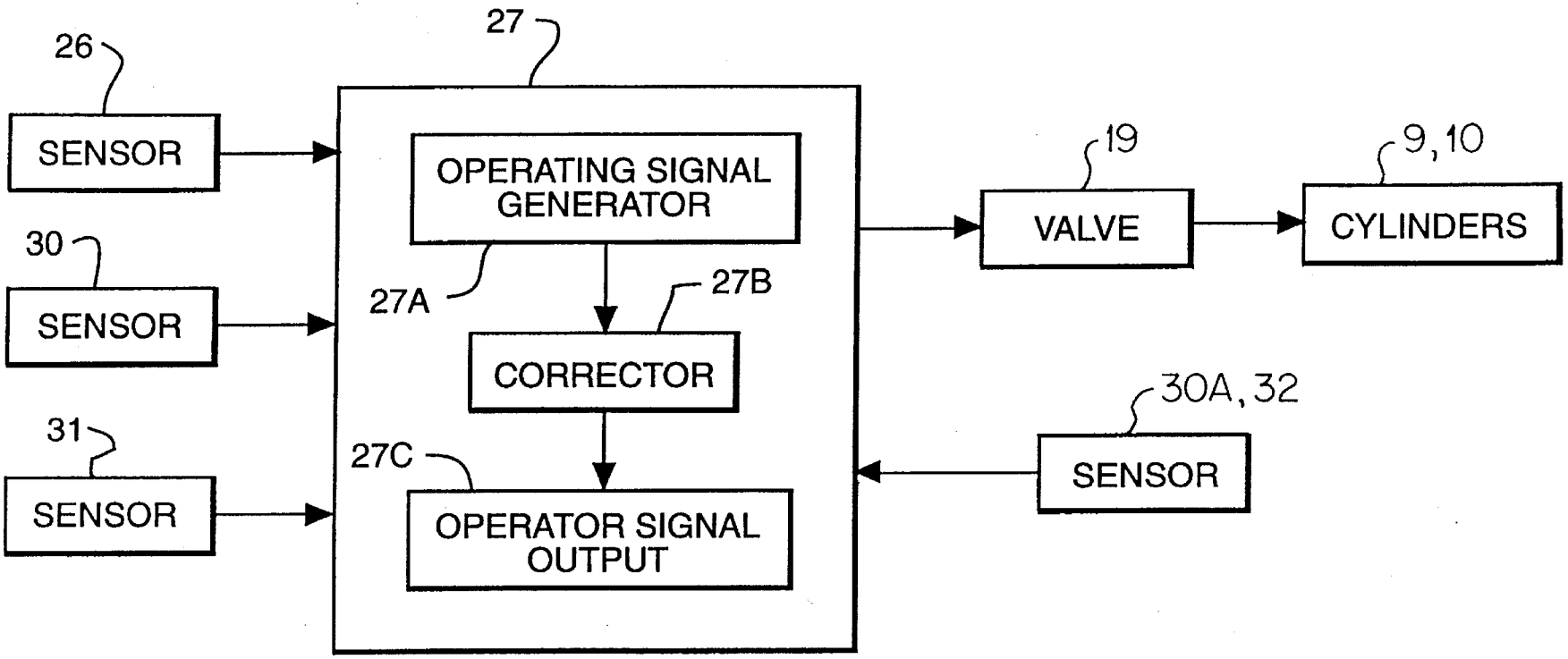
FIG. 5 is a block diagram of a control unit.

The control unit 27 will now be described with reference to FIG. 5.

As noted hereinbefore, the control unit 27 receives the signal from the position sensor 26 of the left control lever 24, and the feedback signal from the sensor 30A which detects an operating state of the control valve 19.

The control unit 27 includes an operating signal generator 27A, a corrector 27B and an operating signal output 27C. The operating signal generator 27A generates an operating signal or control current for controlling the control valve 19 in response to an amount of displacement of the left control lever 24, i.e. the signal from the position sensor 26. The corrector 27B adds to the control current a bias value derived from the feedback signal from the operating state detector 30A. The operating signal output 27C transmits the control current corrected by the corrector 27B to the control valve 19.

Specifically, the corrector 27B adds the start control current I1 as a bias to the original solid line A1 in a position corresponding to the neutral stop position N of the left control lever 24. This newly establishes a dot-and-dash line A2 as shown in FIG. 4. Once the above step is taken, the control unit 27, i.e. the output 27C, thereafter outputs, in response to operation of the left control lever 24, control currents based on the dot-and-dash line A2 instead of the solid line A1 to the electromagnetic proportional control valve 19.

This embodiment adopts as a bias value the current value provided when the electromagnetic proportional control valve 19 starts operating. Of course, it is equally possible to adopt as a bias value a current value provided when the hydraulic cylinders 9 and 10 start action. In the latter case, the operating state detector may be a sensor for detecting movement of the hydraulic cylinders 9 and 10.

The above start control current I1 and new dot-and-dash line A2 are variable for each backhoe implement 7, with a subtle difference in the characteristics of the electromagnetic proportional control valve 19 already in circulation. It is therefore possible to uniform the relationship between control position of the left control lever 24 and flow rate of pressure oil from the electromagnetic proportional control valve 19 (i.e. swing speed of the swing bracket 11) by detecting the start control current I1 and establishing a new dot-and-dash line A2 for each backhoe implement 7. The detection of the start control current I1 or computation of a bias value may be carried out periodically. It is also possible, if necessary, to take these steps on every operating occasion.

In the course of swinging the swing bracket 11, one of the hydraulic cylinders 9 or 10 may lie on the vertical axis P1 of the swing bracket 11 as shown in FIG. 3B. The hydraulic cylinder 9 or 10 lying on the vertical axis P1 does not take part in the operation to swing the swing bracket 11. At this time, only the other hydraulic cylinder 9 or 10 swings the swing bracket 11. As a result, the swing speed of the swing bracket 11 could become slightly lower than the swing speed corresponding to the control position of the left control lever 24.

As a countermeasure to this inconvenience, the preferred embodiment of the present invention, as shown in FIGS. 3A and 2, includes a potentiometer 30 disposed on the vertical axis P1 of the swing bracket 11 for detecting positions of the swing bracket 11. When one of the hydraulic cylinders 9 or 10 lies on the vertical axis P1 of the swing bracket 11 as shown in FIG. 3B, the dot-and-dash line A2 in FIG. 4 is shifted as a whole in a direction to increase the control current. This causes the electromagnetic proportional control valve 19 to supply an increased quantity of pressure oil to one of the hydraulic cylinders 9 or 10. As a result, the swing bracket 11 is swung at the speed corresponding to the control position of the left control lever 24 even by one of the hydraulic cylinders 9 or 10.

Figure 6:
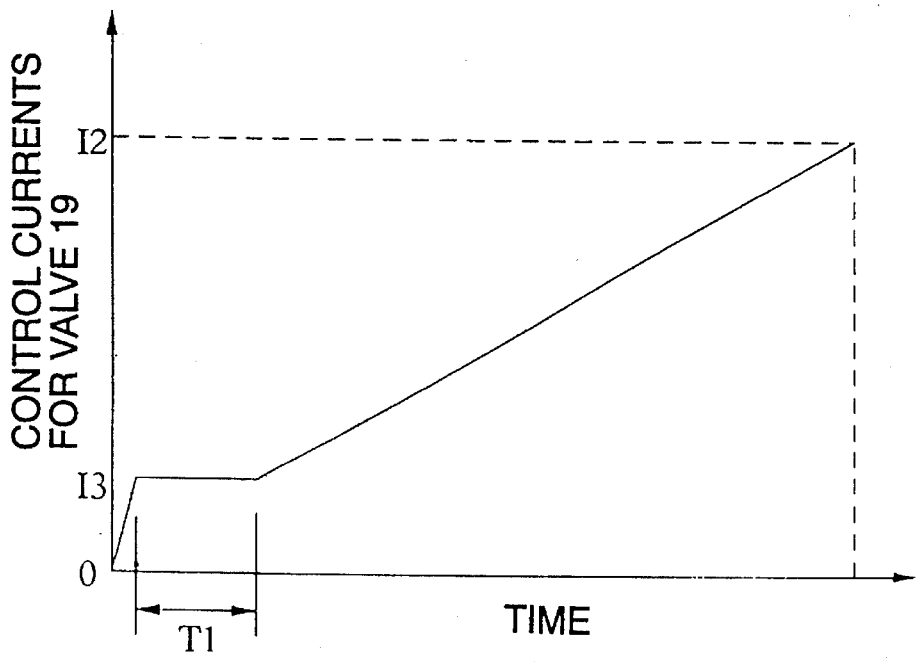
FIG. 6 is a view showing an increase in a control current occurring when the left control lever is operated to a certain control position.

When the left control lever 24 is operated from the neutral stop position N to a certain control position to swing the swing bracket 11, a control operation as shown in FIG. 6 is effected in increasing the control current applied to the electromagnetic proportional control valve 19, to a control current I2 corresponding to the control position of the left control lever 24 (i.e. the control current based on the dot-and-dash line A2 in FIG. 4).

That is, the moment the left control lever 24 starts moving from the neutral stop position N, the control current is increased sharply to a relatively small initial control current I3. This initial control current I3 is maintained for a predetermined time T1. Then, the control current is increased linearly from the initial control current I3 to the control current I2 corresponding to the control position of the left control lever 24.

Consequently, the swing bracket 11 begins to swing smoothly, instead of darting from a standstill state, to reach the swing speed corresponding to the control position of the left control lever 24 (control current I2).

In swinging the swing bracket 11, a stopping position of the swing bracket 11 may be stored electronically. In this case, when the swing bracket 11 is swung from a certain position toward the stored stopping position, the swing bracket 11 may be stopped automatically at the stored stopping position without requiring the left control lever 24 to be returned to the neutral stop position N. For this purpose, a storage switch 31 is provided as shown in FIG. 2. The operator may press this switch 31 when the swing bracket 11 is stopped at a desired position. Then, this position is stored in the control unit 27 as a stopping position.

A preferred hydraulic control will be described next, which is effected when the left control lever 24 is returned to the neutral stop position N from the right or left control position R or L or a control position adjacent thereto.

The control unit 27 has a function to derive a swing speed of the swing bracket 11 from the signal received from the potentiometer 30 for detecting positions of the swing bracket 11 as shown in FIGS. 3A and 2. This is a common technique in controls using a microprocessor, and will not particularly be described herein.

Figure 7:
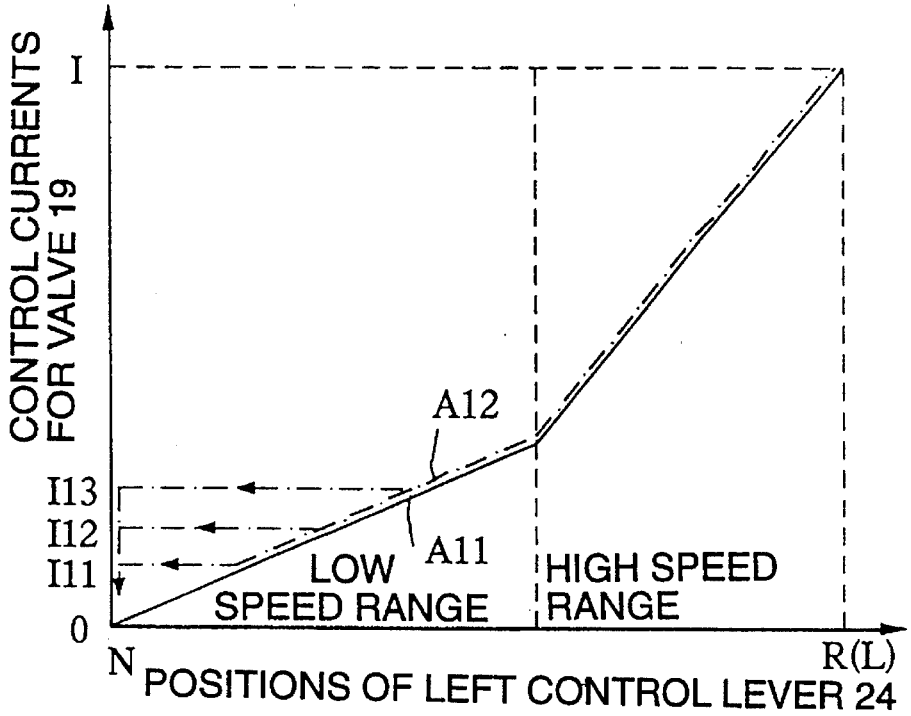
FIG. 7 is a view showing a relationship between control position of the left control lever and control current applied to the electromagnetic proportional control valve, and in particular a state where the left control lever is operated toward a neutral stop position, with the control current maintained in a level corresponding to a predetermined low speed.

Here again, it is assumed that a relationship is set as shown in a solid line A11 in FIG. 7, between detection value of the position sensor 26 for detecting right and left control positions of the left control lever 24 and control current applied to the electromagnetic proportional control valve 19 for controlling the hydraulic cylinders 9 and 10.

Assume that the left control lever 24 is operated toward the right or left control position R or L whereby the swing bracket 11 is swung at a certain speed. When the left control lever 24 is returned from this position toward the neutral stop position N, as shown in a dot-and-dash line A12 in FIG. 7, the control current applied to the electromagnetic proportional control valve 19 is decreased, thereby lowering the swing speed of the swing bracket 11.

When the left control lever 24 is operated to a position short of the neutral stop position N, the swing speed of the swing bracket 11 reaches a predetermined low speed. Then, as shown in the dot-and-dash line A12, the control current for the electromagnetic proportional control valve 19 is maintained to be control current I12 corresponding to the predetermined low speed. When the left control lever 24 subsequently reaches the neutral stop position N, the control current for the electromagnetic proportional control valve 19 is dropped to zero, to stop the swing bracket 11.

When the swing bracket 11 is swung, the backhoe implement 7 itself may have great inertia. Such instances include a case of a large quantity of earth loaded in the bucket 14 of the backhoe implement 7, a case of the boom 12 and arm 13 of the backhoe implement 7 stretched to a great extent rearwardly, and a case of the engine 3 rotating at a high rate to deliver pressure oil at a high flow rate from the pump 25 to the electromagnetic proportional control valve 19.

When, in such a condition, the left control lever 24 is operated toward the neutral stop position N, the swing bracket 11 is not decelerated immediately. The swing speed of the swing bracket 11 reaches the predetermined low speed after the left control lever 24 moves past the control position corresponding to the control current I 12, toward the neutral stop position N.

As a result, the control current for the electromagnetic proportional control valve 19 is maintained to be control current Ill (at a lower level than the control current I12 noted above) corresponding to the predetermined low speed. When the left control lever 24 reaches the neutral stop position N, the control current for the electromagnetic proportional control valve 19 is dropped to zero, to stop the swing bracket 11.

Conversely, when the swing bracket 11 is swung, the backhoe implement 7 itself may have little inertia. Such instances include a case of the bucket 14 of the backhoe implement 7 being empty, a case of the boom 12 and arm 13 of the backhoe implement 7 folded up in a compact form and lying adjacent the tractor body, and a case of the engine 3 rotating at a low rate to deliver pressure oil at a low flow rate from the pump 25 to the electromagnetic proportional control valve 19.

When, in such a condition, the left control lever 24 is operated toward the neutral stop position N, the swing bracket 11 is decelerated immediately. The swing speed of the swing bracket 11 reaches the predetermined low speed before the left control lever 24 reaches the control position corresponding to the control current I12 in FIG. 7.

As a result, the control current for the electromagnetic proportional control valve 19 is maintained to be control current I13 (at a higher level than the control current I12 noted above) corresponding to the predetermined low speed. When the left control lever 24 reaches the neutral stop position N, the control current for the electromagnetic proportional control valve 19 is dropped to zero, to stop the swing bracket 11.

Further, a great load is applied to the swinging operation of the swing bracket 11 when, for example, the swing bracket 11 is swung to move earth on the ground with a side surface of the bucket 14.

Figure 8:
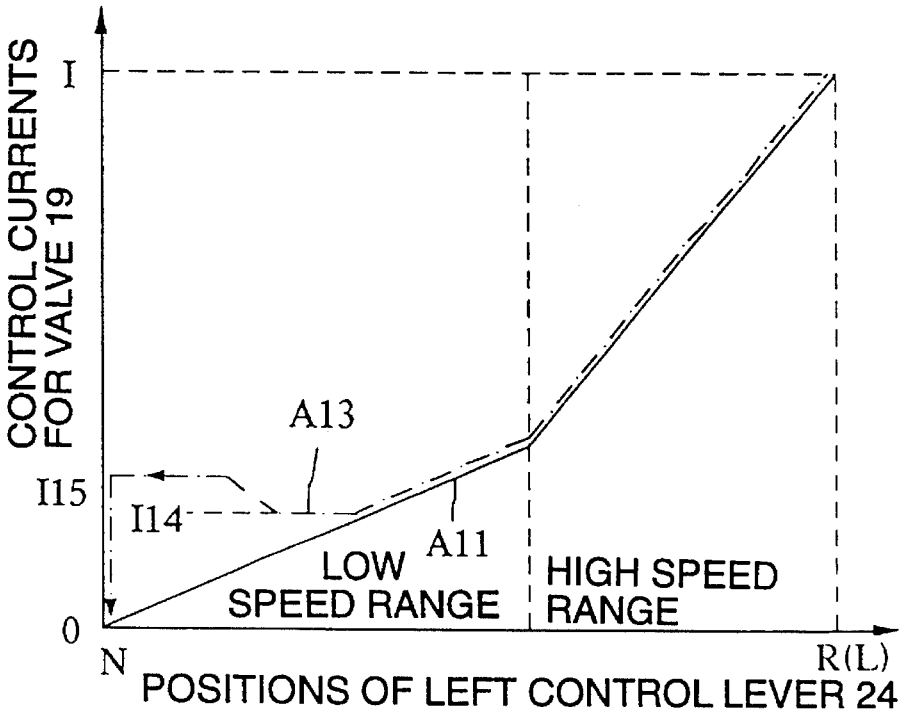
FIG. 8 is a view showing a relationship between control position of the left control lever and control current applied to the electromagnetic proportional control valve, and in particular a state where the left control lever is operated toward the neutral stop position, with the control current maintained level and then increased as a result of excessive deceleration of the backhoe implement.

In this case, when the left control lever 24 is operated toward the neutral stop position N, as shown in a dot-and-dash line A13 in FIG. 8, the control current for the electromagnetic proportional control valve 19 is maintained to be control current I14 corresponding to the predetermined low speed. However, with the control described above, the swing speed of the swing bracket 11 may be greatly decelerated from the predetermined low speed because of the great load applied to the bucket 14. As a result, the swing bracket 11 could stop short of a desired stopping position.

To eliminate this inconvenience, as shown in a dot-and-dash line A13 in FIG. 8, the control current I14 is slightly increased to control current I13 when the swing speed of the swing bracket 11 detected by the potentiometer 30 falls below the predetermined low speed. As a result, the electromagnetic proportional control valve 19 is operated (i.e. opened to a larger degree) to increase the flow rate, thereby checking the deceleration of the swing bracket 11.

Reverting to the control system in the first embodiment, the dot-and-dash line A2 in FIG. 4 may be determined relative to the solid line A1 as follows.

As shown in FIG. 2, the operating state detector comprises a sensor 32 for detecting a rotating rate of the engine 3. Since the pump 25 is driven by the engine 3, a rotating rate of the pump 25, i.e. a flow rate of pressure oil supplied from the pump 25 to the electromagnetic proportional control valve 19, may be determined by detecting the rotating rate of the engine 3.

In this case, the solid line A1 as shown in FIG. 4 is set in relation to a predetermined rotating rate of the engine 3. Upon detection of a rotating rate of the engine 3 exceeding the predetermined rotating rate, the solid line A1 in FIG. 4 is shifted in a direction to reduce the flow rate, whereby the corrector 27B corrects the control current outputted from the control unit 27 to the electromagnetic proportional control valve 19 for a reduced flow rate. Conversely, when the rotating rate of the engine 3 is lower than the predetermined rotating rate, the solid line A1 in FIG. 4 is shifted in a direction to increase the flow rate, whereby the corrector 27B corrects the control current outputted from the control unit 27 to the electromagnetic proportional control valve 19 for an increased flow rate.

This control mode promotes fulfillment of the object to uniform the relationship between control position of the left control lever 24 and flow rate of pressure oil from the electromagnetic proportional control valve 19 (i.e. swing speed of the swing bracket 11 ) regardless of variations in the rotating rate of the engine 3, i.e. in the flow rate of pressure oil supplied from the pump 25 to the electromagnetic proportional control valve 19, occurring in response to varied working conditions.

In the above construction, the rotating rate sensor 32 of the engine 3 may be replaced with a flow rate sensor (not shown) for directly detecting a flow rate of pressure oil from the pump 25.

The hydraulic control system according to the present invention is applicable not only to the swing bracket 11 of the backhoe implement 7, but to the boom 12, arm 13 or other component of the backhoe implement 7. Further, this control system is not limited in application to the backhoe implement 7, but may be applied to the dozer implement 6 or other working implement also.

What is claimed is:

1. A hydraulic control system for controlling a flow control valve to drive a hydraulic actuator in response to operation of a control device, comprising:

position detecting means for detecting a displacement of said control device;

operation detecting means for detecting an operating state of said hydraulic control system; and hydraulic control means for receiving detection signals from said position detecting means and said operation detecting means, said hydraulic control means including:

control signal generating means for generating a control signal to control said flow control valve to an opening degree corresponding to said displacement of said control device;

correcting means for establishing, as a constant bias throughout the operation of said flow control valve, a value of said control signal occurring when said operation detecting means detects start of an operation of said flow control valve, and for applying said bias to said control signal generated by said control signal generating means; and control signal output means for outputting a corrected control signal produced by said correcting means to said flow control valve.

2. A hydraulic control system as defined in claim 1, wherein said operation detecting means is operable to detect an operating speed of said hydraulic actuator, said correcting means being operable, when said operating speed of said hydraulic actuator detected by said operation detecting means reaches a predetermined standard low speed value, to replace forcibly said control signal generated by said control signal generating means with a low speed operation control signal corresponding to said standard low speed value, said control signal output means being operable to output said low speed operation control signal to said flow control valve.

3. A hydraulic control system as defined in claim 2, wherein said correcting means is operable, when said operating speed of said hydraulic actuator detected by said operation detecting means exceeds said predetermined standard low speed value, to replace forcibly said standard low speed value with a second low speed operation control signal for opening said flow control valve to a greater degree, said control signal output means being operable to output said second low speed operation control signal to said flow control valve.

4. A hydraulic control system as defined in claim 1, wherein said correcting means is operable to establish a new bias for each operation of said flow control valve.

5. A hydraulic control system as defined in claim 1, wherein said correcting means is operable to establish a new bias only for start of said hydraulic control system.

6. A hydraulic control system as defined in claim 1, wherein said correcting means is operable to establish a bias for a test mode, said bias being fixed thereafter.

7. A hydraulic control system as defined in claim 1, wherein said flow control valve comprises an electromagnetic proportional control valve with an opening degree adjustable based on a pulse signal acting as said control signal, said control signal generating means being operable to output said pulse signal having a duty ratio corresponding to a value of said control signal.

8. A hydraulic control system as defined in claim 1, wherein said control device is displaceable through an operating region having a predetermined range including a neutral position, said control signal generating means being operable to generate control signal values for opening said flow control valve to the greater degree the farther away said control device is displaced from said neutral position.

9. A hydraulic control system for controlling a flow control valve to drive a hydraulic actuator in response to operation of a control device, comprising:

operation detecting means for detecting an operating state of said hydraulic control system;

flow rate detecting means for detecting an amount of fluid supplied to said flow control valve; and hydraulic control means for receiving detection signals from said position detecting means and said flow rate detecting means, said hydraulic control means including:

control signal generating means for generating a control signal to control said flow control valve to an opening degree corresponding to said displacement of said control device;

correcting means for correcting said control signal generated by said control signal generating means, based on the amount of fluid supplied to said flow control valve and detected by said flow rate detecting means while said operation detection means detects a constant operation state of said hydraulic control system; and control signal output means for outputting a corrected control signal produced by said correcting means to said flow control valve.

10. A hydraulic control system as defined in claim 9, further comprising operation detecting means for detecting an operating state of said hydraulic actuator, said correcting means being operable, when an operating speed of said hydraulic actuator detected by said operation detecting means reaches a predetermined standard low speed value, to replace forcibly said control signal generated by said control signal generating means with a low speed operation control signal corresponding to said standard low speed value, said control signal output means being operable to output said low speed operation control signal to said flow control valve.

11. A hydraulic control system as defined in claim 10, wherein said correcting means is operable, when said operating speed of said hydraulic actuator detected by said operation detecting means exceeds said predetermined standard low speed value, to replace forcibly said standard low speed value with a second low speed operation control signal for opening said flow control valve to a greater degree, said control signal output means being operable to output said second low speed operation control signal to said flow control valve.

12. A hydraulic control system for controlling a flow control valve to drive a hydraulic actuator in response to operation of a control device, comprising:

position detecting means for detecting a displacement of said control device;

operation detecting means for detecting an operating state of said hydraulic actuator; and hydraulic control means for receiving detection signals from said position detecting means and said operation detecting means, said hydraulic control means including:

control signal generating means for generating a control signal to control said flow control valve to an opening degree corresponding to the displacement of said control device;

correcting means operable, when an operating speed of said hydraulic actuator detected by said operation detecting means reaches a predetermined standard low speed value, to replace forcibly said control signal generated by said control signal generating means with a low speed operation control signal corresponding to said standard low speed value; and control signal output means for outputting said low speed operation control signal to said flow control valve.

13. A hydraulic control system for controlling a flow control valve to drive a hydraulic actuator in response to operation of a control device, comprising:

position detecting means for detecting a displacement of said control device;

operation detecting means for detecting an operating state of said hydraulic control system; and hydraulic control means for receiving detection signals from said position detecting means and said operation detecting means, said hydraulic control means including:

control signal generating means for generating a control signal to control said flow control valve to an opening degree corresponding to said displacement of said control device;

correcting means for establishing, as a constant bias throughout the operation of said flow control valve, a value of said control signal occurring when said operation detecting means detects start of an operation of said hydraulic actuator, and for applying said bias to said control signal generated by said control signal generating means; and control signal output means for outputting a corrected control signal produced by said correcting means to said flow control valve.

14. A hydraulic control system for controlling a flow control valve to drive a hydraulic actuator in response to operation of a control device, comprising:

position detecting means for detecting a displacement of said control device;

operation detecting means for detecting an operating state of said hydraulic control system; and hydraulic control means for receiving detection signals from said position detecting means and said operation detecting means, said hydraulic control means including:

control signal generating means for generating a control signal to control said flow control valve to an opening degree corresponding to said displacement of said control device;

correcting means for establishing, as a constant bias throughout the operation of said flow control valve, a value of said control signal occurring when said operation detecting means detects start of an operation of said flow control valve, and for applying said bias to said control signal generated by said control signal generating means; and control signal output means for outputting a corrected control signal produced by said correcting means to said flow control valve.

15. A hydraulic control system as defined in claim 14, wherein said correcting means is operable, when said operating speed of said hydraulic actuator detected by said operation detecting means exceeds said predetermined standard low speed value, to replace forcibly said standard low speed value with a second low speed operation control signal for opening said flow control valve to a greater degree, said control signal output means being operable to output said second low speed operation control signal to said flow control valve.

16. A hydraulic control system for controlling a flow control valve to drive a hydraulic actuator in response to operation of a control device, comprising:

position detecting means for detecting a displacement of said control device;

flow rate detecting means for detecting an amount of fluid supplied to said flow control valve; and hydraulic control means for receiving detection signals from said position detecting means and said flow rate detecting means, said hydraulic control means including:

control signal generating means for generating a control signal to control said flow control valve to an opening degree corresponding to said displacement of said control device;

correcting means for correcting said control signal generated by said control signal generating means, based on the amount of fluid supplied to said flow control valve and detected by said flow rate detecting means;

control signal output means for outputting a corrected control signal produced by said correcting means to said flow control valve; and operation detecting means for detecting an operating state of said hydraulic actuator, said correcting means being operable, when an operating speed of said hydraulic actuator detected by said operation detecting means reaches a predetermined standard low speed value, to replace forcibly said control signal generated by said control signal generating means with a low speed operation control signal corresponding to said standard low speed value, said control signal output means being operable to output said low speed operation control signal to said flow control valve.

17. A hydraulic control system as defined in claim 16, wherein said correcting means is operable, when said operating speed of said hydraulic actuator detected by said operation detecting means exceeds said predetermined standard low speed value, to replace forcibly said standard low speed value with a second low speed operation control signal for opening said flow control valve to a greater degree, said control signal output means being operable to output said second low speed operation control signal to said flow control valve.

* * * * *